US006502311B1

(12) United States Patent
Khachatoorian et al.

(10) Patent No.: US 6,502,311 B1
(45) **Date of Patent: *Jan. 7, 2003**

(54) ADJUSTABLE SAFETY UTILITY KNIFE WITH SLIP RESISTANT ELEMENTS

(75) Inventors: Zareh Khachatoorian, Northridge, CA (US); Jian Ping Qiu, Hangzhou (CN)

(73) Assignee: The Olympia Group, Inc., Industry, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/374,522

(22) Filed: Aug. 14, 1999

(51) Int. Cl.[7] ..... B26B 1/08
(52) U.S. Cl. ..... 30/162; 30/123; 30/124
(58) Field of Search ..... 30/124, 162, 123, 30/334, 340

(56) References Cited

U.S. PATENT DOCUMENTS

| | | | | | |
|---|---|---|---|---|---|
| 3,266,081 | A | * | 8/1966 | Heim | 30/340 |
| 3,520,059 | A | * | 7/1970 | Gringer | 30/340 |
| 4,226,020 | A | * | 10/1980 | Quenot et al. | 30/162 |
| 4,794,692 | A | * | 1/1989 | Wang | 30/123 |
| 4,825,552 | A | * | 5/1989 | Bendickson et al. | 30/340 |
| 4,970,785 | A | * | 11/1990 | Collins | 30/123 |
| 5,121,544 | A | * | 6/1992 | Gilbert | 30/162 |
| 5,138,768 | A | * | 8/1992 | Collins | 30/162 |
| 5,301,428 | A | * | 4/1994 | Wilcox | 30/162 |
| 5,502,896 | A | * | 4/1996 | Chen | 30/162 |
| 5,528,834 | A | * | 6/1996 | Seber et al. | 30/340 |
| 5,551,157 | A | * | 9/1996 | Wu | 30/340 |
| 5,644,843 | A | * | 7/1997 | Young | 30/124 |
| 5,678,316 | A | * | 10/1997 | Althaus et al. | 30/340 |
| 5,979,057 | A | * | 11/1999 | Chao | 30/162 |

FOREIGN PATENT DOCUMENTS

| | | | | |
|---|---|---|---|---|
| DE | 2827381 | * | 8/1979 | 30/162 |
| WO | WO 88/07918 | * | 10/1988 | 30/162 |

* cited by examiner

*Primary Examiner*—Kenneth E. Peterson
*Assistant Examiner*—Omar Flores-Sánchez
(74) *Attorney, Agent, or Firm*—Lackenbach Siegel LLP

(57) ABSTRACT

An adjustable safety utility knife includes a elongated ergonomically shaped handle formed of two elongate shell members each having a peripheral edge and an outer, generally convex surface and an inner generally concave surface. A fastener secures the shell members together at their peripheral edges along a parting plane to form an elongated internal cavity. The handle defines a front end, back end and an intermediate portion suitable for being gripped by a user and also defines top and bottom surfaces extending along opposite sides of the shell members along the peripheral edges. The handle has a slot-like aperture at the front end substantially aligned with the parting plane and dimensioned for passage of a flat cutting blade therethrough. The cutting blade is mounted for movement by a suitable guide member or a carriage between a first position for safely storing the blade fully inside the cavity and a second position for selectively extending the blade beyond the aperture to expose at least a portion thereof. A manually operated button is arranged on the top surface of the handle and is coupled to guide element or blade carriage for selectively moving the blade between the first and second positions. Slip resistant elements are secured to the shell members along the top and bottom surface between a rearwardmost operative position of the manually operated button and the back end of the handle. The slip resistant elements generally conform to the outer convex surface of the handle and enhance gripping of the handle and minimize slippage thereof during use of the utility knife when gripped by a user.

2 Claims, 2 Drawing Sheets

ADJUSTABLE SAFETY UTILITY KNIFE WITH SLIP RESISTANT ELEMENTS

BACKGROUND OF THE INVENTION

1. Field of the Invention

The present invention generally relates to hand tools and, more specifically, to an adjustable safety utility knife with slip resistant elements.

2. Description of the Prior Art

Utility knives are widely used in construction, business and hobby applications for cutting such materials as paperboard, wallboard, tiles, string and other objects. Typically, such utility knives are in the form of an elongate hollow housing that can be gripped by the user along an intermediate portion thereof and into which there are placed trapezoidal flat cutting blades. The blades typically have a single cutting edge. The blade is typically slidably mounted on a carrier for movement between a retracted position within the housing and an extended position in which the cutting edge is at least partially exposed through a front end aperture or slot, the carrier being coupled to a manually operated element, such as a button positioned in a manner convenient to be actuated by the user's hand.

Many utility knives include a region within the housing for storing one or two additional blades that can be used to replace the operative blade when it becomes dull. In most cases a screw or similar means is used for attaching the two clam shell members together during normal use. When blades need to be replaced, the screw is removed, allowing to two shell members to be separated, and access is provide to the replacement blades.

While the flat cutting blades used in utility knives are relatively thin, substantial frictional forces are frequently applied to or exerted on these blades, such as when the blades are used to cut heavy or thick cardboard, wallboard or the like. As typically used, the utility knives are placed on the material to be cut and, with the blade penetrated through the material, and with the user's hand extended, the utility knife is pulled toward the user to effect the cutting. The frictional forces resulting on the blade are such as to pull on the utility knife in the opposite direction, tending to pull the utility knife out of the hand of the user. It is desirable that the user continue to maintain a good grip on the utility knife for safety reasons as well as to prevent damage to the workpiece being cut. Known utility knives, however, are typically made of metallic housings which provide a limited amount of friction between the exterior surface of the housing and the user's hand. Attempts have been made to increase the amount of friction available for this purpose by texturing the surface by providing ribs, knurling, etc. While such textured surfaces have somewhat increased the ability of the user to grip the utility knife housing, the greater the surface irregularities to enhance the gripping action, the more uncomfortable the knife is to use as any such surface irregularities tend to penetrate the skin of the user when the knife is tightly gripped to overcome the pulling frictional forces on the blade.

SUMMARY OF THE INVENTION

Accordingly, it is an object of the present invention to provide an adjustable safety utility knife which does not have the disadvantages inherent in known utility knives.

It is another object of the present invention to provide an adjustable safety utility knife which is simple in construction and economical to manufacture.

It is still another object of the present invention to provide a safety utility knife as in the previous objects which enhances the frictional grip to a user of the utility knife housing to counteract the pulling forces on the blade during cutting.

It is yet another object of the present invention to provide an adjustable safety utility knife as in the present invention which is comfortable to the user, substantially independently of the tightness of the grip by the user on the handle on the knife.

It is a further object of the present invention to provide an adjustable safety utility knife which is safe and convenient to use and minimizes the probability that the utility knife will be inadvertently or accidentally pulled out of the user's hand when cutting thick or heavy objects.

It is still a further object of the present invention to provide an adjustable safety utility knife which provides the user added control over the knife during use, particularly during cutting of thick or heavy objects, thereby minimizing the probability of damage to the material being cut.

In order to achieve the above objects, and others which will become apparent hereinafter, an adjustable safety utility knife in accordance with the present invention comprises an elongated ergonomically shaped handle formed of two elongate shell members, each having a peripheral edge and an outer convex surface and an inner generally concave surface. Fastening means is provided for fastening such shell members at said peripheral edges along a vertical parting plane to form an elongated internal cavity. Said handle defines a front end, a back end and an intermediate portion suitable for being gripped by a user and also defining top and bottom surfaces extending along opposite sides of said front end substantially aligned with said parting plane and dimensioned for passage of a flat cutting blade therethrough. Guide means is provided within said elongated cavity for guiding the cutting blade between a first position for safely storing the blade fully inside said cavity and a second position for selectively extending the blade beyond said aperture to expose at least a portion thereof A manually operated button is arranged on said top surface and coupled to said guide means for selectively moving the blade between said first and second positions. Slip resistant means is provided secured to said shell along said top and bottom surfaces between a rearmost operative position of said manually operated button and said back end. Such slip resistant means generally conforms to said outer convex surface and enhances gripping of said handle and minimizes slippage of said handle during use of the utility knife when gripped by a user.

BRIEF DESCRIPTION OF THE DRAWINGS

Other aspects, objects and advantages of the present invention will become apparent upon reading of the following detailed description of the preferred embodiment of the present invention when taken in conjunction with the drawings, as follows.

DETAILED DESCRIPTION OF A PREFERRED EMBODIMENT

Figure 1:
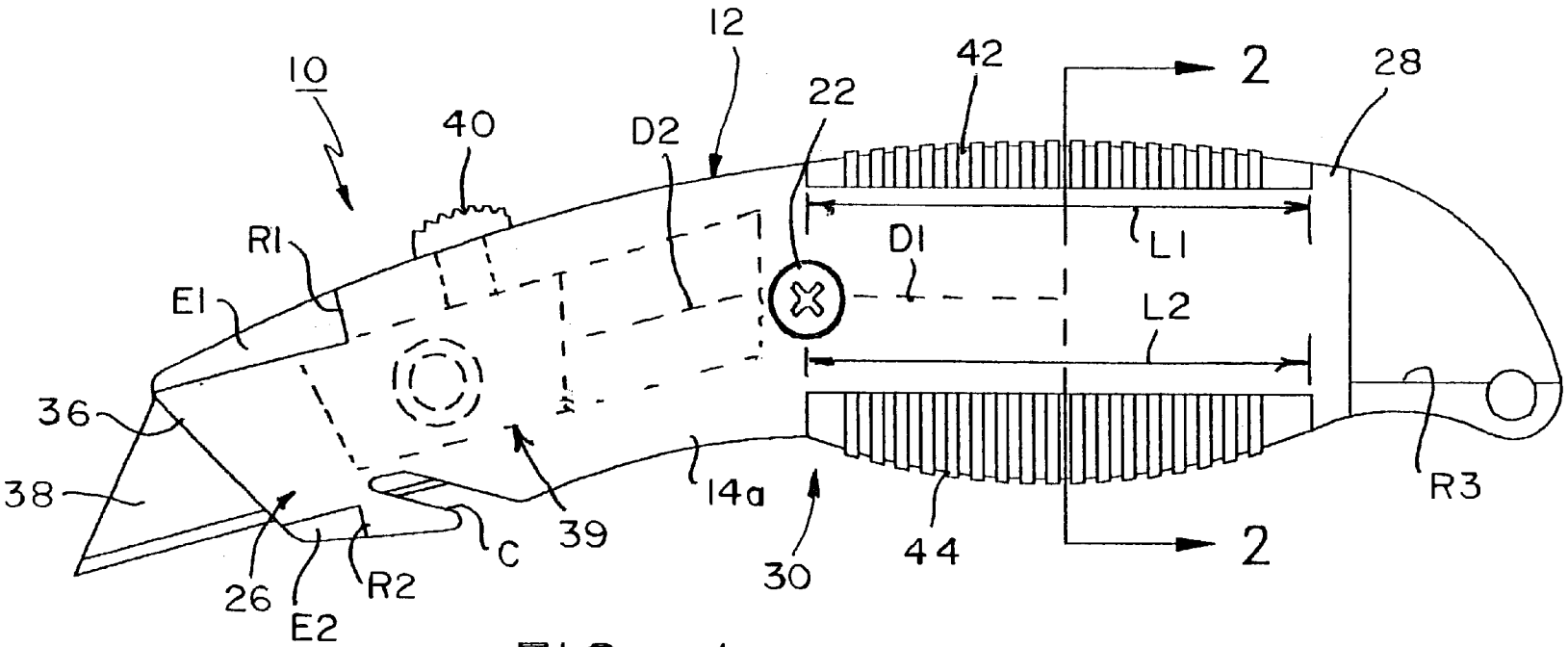
FIG. 1 is a side elevational view of an adjustable safety utility knife with slip resistant elements in accordance with the invention.

Referring now to the Figs., in which identical or similar parts will be designated by the same reference numerals throughout, and first referring to FIG. 1, an adjustable safety utility knife in accordance with the present invention is generally designated by the reference numeral 10.

The utility knife 10 includes an elongated ergonomically shaped handle 12 formed of two elongate shell members 14*a*, 14*b*, each having a peripheral edge 16*a*, 16*b* (FIG. 2), respectively, and outer, generally convex surface 18*a*, 18*b* and an inner generally concave surface 20*a*, 20*b*, respectively. A suitable fastener, such as a transverse screw 22 (FIG. 1) is provided for fastening the shell members 14*a*, 14*b* to each other at the peripheral edges 16*a*, 16*b* along a parting plane P (FIG. 2) to form an elongated internal cavity or compartment 24. The handle 12 defines a front end 26, a back end 28 and an intermediate portion 30 suitable to be gripped by the user, also defining top and bottom surfaces 32, 34, respectively, extending along tops and sides of the shell members 14*a*, 14*b* along the peripheral edges. The handle 12 has a conventional slot-like aperture 36 (FIG. 1) and a front end 26 substantially aligned with the parting plane P and dimensioned for passage of a flat cutting blade 38 therethrough. A guide member, in the form of a carriage 39, is provided within the cavity 24, in the front end 26 for guiding the cutting blade 38 between a first portion for safely storing the blade 40 inside of the cavity and a second position for selectively extending the blade beyond the aperture 36 for exposing a portion thereof, as shown in FIG. 1. The carriage or the blade is shown in phantom outline, the details thereof being more fully described in co-pending U.S. patent application Ser. No. 09/374,523, which has been assigned to the same assignee as the present application. A manually operated button 40, of the type frequently used in utility knives of this kind, is arranged on the top surface 32 and coupled to the guide element for selectively moving the blade 38 between the first and second positions.

In accordance with an important feature of the present invention, slip resistant elements 42, 44 are provided and arranged on the top surface 32 and coupled to guide mechanism for selectively moving the blade 38 between the first and second positions.

An important feature of the present invention is the provision of the slip resistant elements 42, 44 secured between the shell members or the top and bottom surfaces 32, 34, respectively, between a rearwardmost operative position of the manually operative button and the back end 28. The slip resistant elements 42, 44 generally conform to the outer convex surface 18*a*, 18*b* and enhance the gripping of the handle 12 and minimize slippage of the handle during use of the utility knife when gripped by the user.

As the shell members are fastened together by means of a single screw 22, the shell members are preferably provided with one or more cutouts or recesses in one of the shell members and extensions in the other shell member that mate therewith. In the embodiment illustrated in FIG. 1, the shell member 14*a* is provided at the front end 26 thereof with upper and lower recesses or cutouts R1, R2 that receive conforming transverse extensions E1, E2 which are integrally formed on the opposing shell member 14*b*. It will be appreciated that when the recesses and extensions mate and interlock as shown, it will be clear that the shell members will not have a tendency to rotate or shift in relation to each other.

The blade guide element or carriage 39 is arranged on suitable guide surfaces (not shown) for guiding the cutting blade between a first position for safely storing the blade fully inside the cavity 24 and a second position for selectively extending the blade beyond the aperture 36 to expose at least a portion thereof, as shown in FIG. 1.

The manually operated button 40 is arranged on the top surface 32 and coupled to the guide element or carriage 39 for selectively moving the blade between the first and second positions.

Slip resistant elements 42, 44 are secured to the shell members 14*a*, 14*b* along the top and bottom surfaces between a rearwardmost operative position of the manually operated button 40 and the back end, the slip resistant elements 42, 44 generally conforming to the outer convex surface of the handle housing and enhance the gripping by the user of the handle and minimize slippage of the handle during use of the utility knife when gripped by a user.

Preferably, the slip resistant elements 42, 44 are formed of an elastomeric or rubber-like material.

Figure 2:
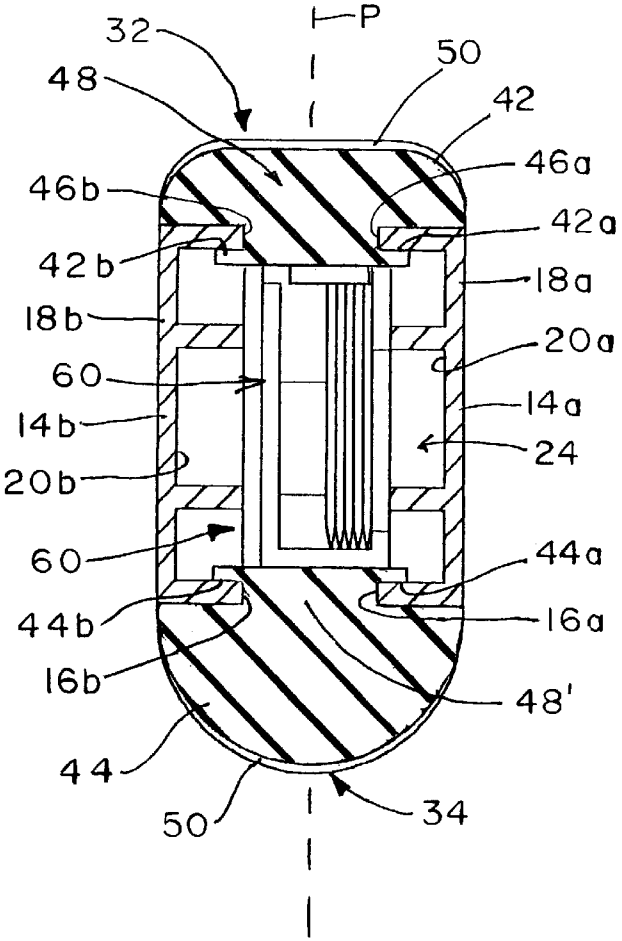
FIG. 2 is a cross sectional view of the utility knife shown in FIG. 1, taken along line 2—2.

The specific manner of attaching the slip resistant elements 42, 44 to the handle 12 is not critical, and any suitable or conventional method of attaching same to the handle may be used. Referring to FIG. 2, however, one presently preferred embodiment is illustrated in which the slip resistant elements 42, 44 are generally in the form of rectilinear strips having first and second predetermined lengths L1, L2 along the top and bottom surfaces, respectively. The peripheral edges along each of the predetermined lengths of the top and bottom surfaces have generally U-shaped offsets to each side of the parting plane P which together form a generally elongate rectangular opening defining opposite edges 46*a*, 46*b* that are generally parallel to the parting plane. Each slip resistant element 42, 44 has dimensions substantially corresponding to an associated rectangular opening and has opposite lateral grooves 42*a*, 42*b* arranged to receive associated edges 46*a*, 46*b* and 16*a*, 16*b* in a tongue-and-groove configuration to secure each strip within an associated opening in the handle housing.

While it is not critical, the predetermined lengths L1 and L2 need not be equal to each other. However, in the preferred embodiment they are approximately equal to each other to provide the user with a substantial gripping area.

Each of the slip resistant elements is formed so as to enhance the gripping action. Thus, the elements are preferably provided with external grip enhancing protuberances. In the embodiment shown, such protuberances are in the form of a plurality of transverse ribs that extend in a direction generally normal or transverse to the parting plane P.

As best shown in FIG. 1, the handle 12 is formed of forward and rearward handle portions, each of which is substantially straight and defines a longitudinal direction, directions D1 and D2, as indicated in FIG. 1. The longitudinal directions are slightly angularly offset from each other, the slip resistant material being placed on a substantial length of the rear handle portion. Towards that end, each of the slip resistant elements preferably protrudes slightly beyond the top and bottom surfaces to provide a positive grip with the hand of the user. In the embodiment shown, such slip resistant strips form generally outwardly shaped arcuate profiles along the longitudinal directions of the handle. The specific shape and surface texture, however, is not critical. Thus, for example, the slip resistant elements may also be formed of a foam-like material of sufficient density to withstand significant squeezing action or pressures applied thereon.

The handle 12 is also shown in FIG. 1 to include a channel C proximate to the front end 26 and along the bottom surface 34 which can be used to cut filamentary material such as string or rope, even when the blade 38 is fully retracted, as the edge of the blade continues to be exposed even when retracted.

The specific details of the carriage 39 is disclosed, as aforementioned, in U.S. patent application Ser. No. 09/374,523. Similarly, although the subject application does not address the blade holder 60 or reservoir of blades, these can normally be contained within the back end of the handle for storing a cartridge of blades therein. The details of the cartridge of spare blades and the manner in which it is constructed and used are more specifically described in U.S. patent application Ser. No. 09/374,524, assigned to the same assignee as the present application. The invention has been shown and described by way of a presently preferred embodiment, and many variations and modifications may be made therein without departing from the spirit of the invention. The invention, therefore, is not to be limited to any specified form or embodiment, except insofar as such limitations are expressly set forth in the claims.

What we claim:

1. An adjustable safety knife comprising an elongate ergonomically shaped handle formed of two elongate shell members each having a peripheral edge and an outer generally convex surface and an inner generally concave surface; fastening means for fastening said shell members at said peripheral edges along a parting line defining a parting plane to form an elongated internal cavity, said handle defining a front end, a back end and an intermediate portion suitable for being gripped by a user and also defining top and bottom surfaces extending along opposite sides of shell members along said peripheral edges, said handle having a slot-like aperture at said front end substantially aligned with said parting plane and dimensioned for passage of a flat cutting blade therethrough; guide means within said elongated cavity for guiding the cutting blade between a first position for safely storing the blade beyond said aperture to expose at least a portion thereof; a manually operated button arranged on said top surface and coupled to said guide means for selectively moving the blade between said first and second positions; and slip resistant means and secured to said shell members along said top and bottom surfaces between a rearwardmost operative position of said manually operated button and said back end, said slip resistant means generally conforming to said outer convex surface and enhancing gripping of said handle and minimizing slippage of said handle during use of the utility knife when gripped by a user, said slip resistant means comprising generally rectilinear strips having first and second predetermined lengths along said top and bottom surfaces, respectively, said peripheral edges along each of said predetermined lengths of said top and bottom surfaces having generally U-shaped offsets to each side of said parting plane which together form a generally elongate rectangular opening defining opposing edges generally parallel to said parting plane, each slip resistant means having dimensions substantially corresponding to an associated rectangular opening and having opposing lateral grooves arranged to receive associated edges of a rectangular opening in a tongue-and-groove configuration to secure each strip within an associated opening.

2. An adjustable safety knife comprising an elongate ergonomically shaped handle formed of two elongate shell members each having a peripheral edge and an outer generally convex surface and an inner generally concave surface; fastening means for fastening said shell members at said peripheral edges along a parting line defining a parting plane to form an elongated internal cavity, said handle defining a front end, a back end and an intermediate portion suitable for being gripped by a user and also defining top and bottom surfaces extending along opposite sides of shell members along said peripheral edges, said handle having a slot-like aperture at said front end substantially aligned with said parting plane and dimensioned for the passage of a flat cutting blade therethrough; guide means within said elongated cavity for guiding the cutting blade between a first position for safely storing the blade beyond said aperture to expose at least a portion thereof; a manually operated button arranged on said top surface and coupled to said guide means for selectively moving the blade between said first and second positions; and slip resistant means and secured to said shell members along said top and bottom surfaces between a rearwardmost operative position of said manually operated button and said back end, said slip resistant means generally conforming to said outer convex surface and enhancing gripping of said handle and minimizing slippage of said handle during use of the utility knife when gripped by a user, said slip resistant means comprising generally rectilinear strips having first and second predetermined lengths along said top and bottom surfaces, respectively, said peripheral edges along each of said predetermined lengths of said top and bottom surfaces having generally U-shaped offsets to each side of said parting plane which together form a generally elongate rectangular opening defining opposing edges generally parallel to said parting plane, each slip resistant means having dimensions substantially corresponding to an associated rectangular opening and having opposing lateral grooves arranged to receive associated edges of a rectangular opening in a tongue-and-groove configuration to secure each strip within an associated opening, wherein said first and second predetermined lengths are approximately equal to each other.

* * * * *